United States Patent [19]

Stenvall

[11] Patent Number: 4,512,590

[45] Date of Patent: Apr. 23, 1985

[54] ROLLER SKATE

[75] Inventor: Carl-Johan Stenvall, Älvsbyn, Sweden

[73] Assignee: NPI New Products Investment AB, Askim, Sweden

[21] Appl. No.: 453,882

[22] PCT Filed: Apr. 14, 1982

[86] PCT No.: PCT/SE82/00122

§ 371 Date: Dec. 13, 1982

§ 102(e) Date: Dec. 13, 1982

[87] PCT Pub. No.: WO82/03560

PCT Pub. Date: Oct. 28, 1982

[30] Foreign Application Priority Data

Apr. 15, 1981 [SE] Sweden ..... 8102439

[51] Int. Cl.[3] ..... A63C 17/06

[52] U.S. Cl. ..... 280/11.23

[58] Field of Search ..... 280/11.23, 11.25, 11.22, 280/11.27, 11.28

[56] References Cited

U.S. PATENT DOCUMENTS

| | | | |
|---|---|---|---|
| 918,575 | 4/1909 | Mees | 280/11.23 |
| 2,529,314 | 11/1950 | Schmid | 280/11.23 |
| 2,552,987 | 5/1951 | Loertz, Jr. | 280/11.23 |
| 4,132,425 | 1/1979 | Lehner et al. | 280/11.23 |
| 4,392,659 | 7/1983 | Yoshimoto | 280/11.23 |

*Primary Examiner*—Richard A. Bertsch

[57] ABSTRACT

Roller skate comprising a plate (1) for the user's foot and one front wheel (2) and a rear wheel (3) having a convex curved running surface and rotably mounted on shafts (7, 5). One wheel is pivotable between side angle positions on either side of a center position in which the direction of rolling of the wheel concerned extends in the longitudinal direction of the skate. A steering mechanism (15) is provided for pivoting of the wheel (2) and having a sensing member (22) which is arranged to rest against the subsurface on which the wheel is designed to roll. The sensing member is connected with the pivotable wheel in such a way that the angle of pivoting is governed by the inclination of the skate in relation to the subsurface, due to the member resting against the subsurface. The steering arrangement is so designed that the rolling direction of the wheel extends in the longitudinal direction of the skate when this adopts a position at right angles to the subsurface with its standing longitudinal plane, while when the skate is inclined towards the subsurface during rolling it swivels in a different direction dependent on the direction of the inclination.

6 Claims, 2 Drawing Figures

ROLLER SKATE

TECHNICAL FIELD

The present invention relates to a roller skate which comprises a front and a rear wheel which are mounted on a footplate and preferably having a convex curved running surface, where at least one wheel is steerable.

BACKGROUND

Conventional roller skates are as is known provided with double wheels both at the front and back and can be guided to a certain extent by imposing an oblique loading on the footplate which is rotable around an axis which in relation to the wheel axes extends at right angles and in the lengthwise direction of the roller skate. So as to obtain a better simulation of ice skating, attempts have been made to employ roller skates of the single-wheel type, i.e. roller skates with only one front and one rear wheel.

TECHNICAL PROBLEM

However none of these types of roller skates has provided satisfactory guidance possibilities. With the single wheel type of roller skate the wheels must be inclined or sloped in relation to the vertical plane if turning is to be at all possible, but such inclination of the skate does not however provide adequate steerability.

THE SOLUTION

With roller skates in accordance with the invention at least one of the wheels is pivotable relative to the footplate around an axis which is at right angles to the plane of the footplate and the wheel is under the influence of a steering member which twists it in either direction around the axis dependent on the inclination of the roller skate.

ADVANTAGES

The invention provides a roller skate of the single-wheel type which has considerably improved steerability as compared with known roller skates.

BRIEF DESCRIPTION OF DRAWINGS

In the following the invention will be described in greater detail by reference to the attached drawing in which.

BEST MODE OF CARRYING OUT THE INVENTION

Figure 2:
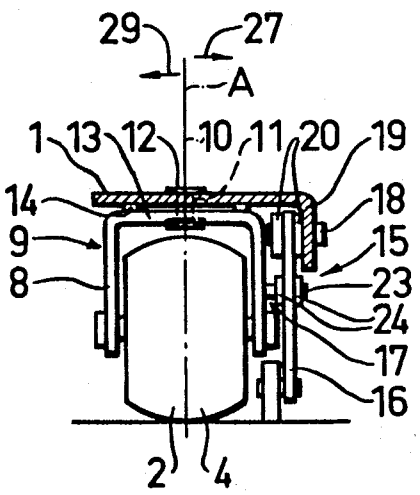
FIG. 1 illustrates the side view of a preferred embodiment of the invention and FIG. 2 illustrates a section essentially along the line II—II in FIG. 1.

The roller skate in accordance with this invention is of the single-wheel type and comprises a footplate 1 and one front and one rear wheel, 2 and 3 respectively. The footplate has a top surface which is to support the foot and a lower face which during use is directed towards the skating surface. The wheels 2, 3 can be of metal or hard plastic and have a convex curved running surface 4 so that the contact surface between the wheel and the subsurface, or ground, is essentially point-like, regardless of the way in which the roller skate is inclined to one or other direction in relation to the subsurface.

The rear wheel 3 is mounted on a shaft 5 which is supported by legs 6 which extend from the underside of the footplate and which are fixed to the footplate 1 or made in one piece with it. The front wheel 2 is mounted on a shaft 7 which is supported by legs 8 on a U-shaped yoke 9 which furthermore has a cross-piece 13 which extends between the legs. This yoke 9 is however rotably mounted on the underside of the footplate 1 so that the wheel can perform a pivoting movement around an axis 10 which extends at right angles in relation to the plane of the footplate. More particularly, the yoke 9 is rotably connected with the footplate 1 by means of a pin 11 or the like with heads 12 which rest against the top face of the footplate and against the underside of the yoke, which heads thus hold the footplate 1 and the yoke 9 together. A bearing 14, e.g. a roller bearing for facilitating the rotary movement of the wheel relative to the footplate is provided between the footplate 1 and the cross-piece 13 of the yoke.

In accordance with the present invention a steering mechanism 15 which can pivot the wheel and which is effective on the wheel 2 is provided for turning the wheel 2 for steering the roller skate in a rolling direction which is to be determined by the angle of inclination of the roller skate against the subsurface. The steering mechanism 15 comprises a steering arm 16 located on one side of the skate and a connecting link 17 between the steering arm and the yoke 9 of the rotable wheel. At its free end the steering arm 16 supports a roller 22 and at its other end it is swivel-mounted on a pin 18 which is fastened to a fixing lug 19 connected with the footplate and located at a distance from the yoke 9. The connection between the pin 18 and the steering arm 16 can comprise a ball and socket joint or other arrangement performing the function of the ball and socket joint so that the steering arm 16 can not only swivel around the pin but also can incline in relation to its pin 18. In the example illustrated this ball and socket joint function is achieved in that the pin 18 has a diameter which is smaller than that of the hole in the steering arm 16 through which the pin 18 passes, elastic bushings 20, preferably of rubber, being fixed to the pin 18 on both sides of the steering arm 16 so as to regulate and restrict at least the flexibility of movement of the steering arm laterally. Furthermore the steering arm 16 is under the influence of a spring 21 which is so arranged that it tries to keep the supporting roller 22, arranged at the steering arm at its end which faces away from its swivelling point 18, resting against the subsurface.

The connecting link 17 between the yoke 9 and steering arm 16 comprises a pin 23 which is fastened to one of the legs 8 of the yoke and which extends inwards through a hole in the steering arm 16 at a radial distance from the latter's swivelling axis. The hole is of a diameter larger than that of the pin 23, which on both sides of the steering arm 16 is provided with elastic bushings 24, preferably of rubber. The bushings fix the steering arm 16 on the pin 23 but permit relative movement between the latter in the same way as does the connection between the steering arm 16 and its swivel pin 18. Like the connection between the steering arm 16 and its swivel pin 18, the connection between the pin 23 and steering arm 16 can also be in the form of some known type of ball and socket joint, even though this is not indicated on the drawing.

The drawing shows the roller skate in accordance with the invention where it is also provided with toe stops 26 which can be of some known type.

Figure 1:
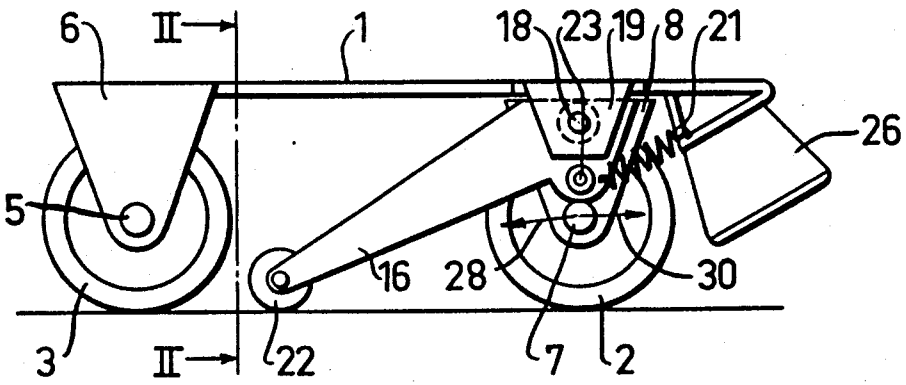

The roller skate in accordance with the invention functions as follows. As an example it is assumed that the roller skate illustrated on the drawing is a skate for the right foot. In order to skate straight ahead the longitudinal plane the roller skate is maintained at right angle to the subsurface, this longitudinal plane being designated as A in FIG. 2. Here the steering mechanism 15 is so adapted, as a result of suitable dimensioning and connection between its components, that the axis 7 of the rotable wheel 2 is at right angles to plane A, so that the rolling direction of the wheel extends in this plane. The wheel axes 5 and 7 are in this position thus parallel with each other and the pins 18 and 23 are in line with the axis 7 of the swivel wheel. If an outside turn is required, i.e. a turn towards the right in FIG. 2, the roller skate is inclined outwards, i.e. the plane A moves in relation to the subsurface indicated by the arrow 27 in FIG. 2, as a result of which the steering arm 16 swivels inwards towards the footplate 1 around its pin 18 and as a result of which the portion of pin 23 located in its steering arm is also caused to move along an essentially curved path around the pin 18 and by this means to rotate the yoke 9 around its axis 10 in the direction indicated in FIG. 1 by arrow 28. Thus the wheel 2 is automatically adjusted to the desired skating direction. In the same way, the wheel is turned into the opposite direction if the roller skate in inclined inwards, i.e. in the direction of arrow 29, in order to perform an inner turn, i.e. to turn to the left in FIG. 2. Here the spring 21 provides the swivelling of the steering arm 16 around its pin 18 which is required for steering purposes and which swivels the wheel in the direction of arrow 30 around axis 10.

Hence the roller 22 comprises a member which senses whether and how the subsurface is inclined in relation to a plane which is at right angles to the plane A and is a tangent to the contact surfaces of the wheels.

The present invention is not restricted to the embodiment described above and illustrated on the drawing, but can also be changed, modified and supplemented in many different ways within the framework of the concept of the invention described in the patent claims. The essential feature of the invention is that a member rests in such a way against the skating subsurface that the angle of the roller skate relative to the subsurface is sensed in such a way that the direction of rolling of the steerable wheel or wheels is altered in accordance with the angle of inclination in the manner specified above. Both the member which rests against the subsurface and the steering mechanism as such can be designed in different ways within the framework of this function. Thus it is completely within the framework of the inventive concept to provide a steering arm 16 on each side of the roller skate, so that positive steering without spring action can be achieved. The sensing member need not be supported by an arm at all, but can for example perform a slide-controlled movement. Furthermore it does not need exclusively to be the front wheel which is steerable, for instead the rear wheel can be steerable instead of the front wheel, or together with the latter, arranged in accordance with the principles described above and which exemplify the present invention. This can easily be perceived if we imagine the wheel denoted on the drawing by 2 as being the rear wheel of the roller skate.

I claim:

1. A roller skate comprising an elongated plate for supporting a user's foot, said plate having a front portion and a rear portion, at least one front wheel, at least one rear wheel, each wheel being rotatably mounted on a shaft and having a convex curved running surface for rolling on a sub-surface; means for pivotally connecting one of said wheels to one of said portions of said plate so that said one wheel is swivable about an axis in a longitudinal central plane through said plate; and a steering mechanism for said one wheel and comprising a sensing member for rolling on said sub-surface, and means interposed between said sensing member, said connecting means and said plate, the arrangement being such that the angle of swivelling of said wheel is determined by the inclination of the said plane in relation to the subsurface, as said member, as a result of support against the subsurface, is located at different distances from a plane at right angles to the said longitudinal plane and at a tangent to the running surfaces of the wheels.

2. A roller skate according to claim 1, wherein said steering mechanism includes a steering arm, means pivotally connecting said arm to said plate, a spring biasing said arm to swivel about said pivotal connecting means, said sensing member being located at an end of said arm remote from said pivotal connecting means, a link connecting said arm to said pivotal connecting means between said one wheel and said plate so that when the skate is inclined at different angles with respect to the subsurface said member causes said arm to swivel and thus transfer its swivelling motion to the pivotal connecting means between said one wheel and said plate.

3. A roller skate according to claim 2, wherein said member is a roller rotatably mounted at said end of said arm.

4. A roller skate in accordance with claim 2, wherein said pivotal connecting means between said one wheel and said plate comprises a yoke with legs which support the shaft of said one wheel and with a cross-piece pivotally mounted about a shaft in said plate forming said pivotal connecting means between said plate and said one wheel.

5. A roller skate according to claim 4, wherein said shaft in said plate is a pin, and a bearing between said yoke and said plate.

6. A roller skate according to claim 4, wherein said link comprises a pin fastened to said yoke and connected to an articulated manner to said steering arm at a radial distance from said pivotal connecting means between said arm and said plate.

* * * * *